US006977589B2

(12) United States Patent
Loop et al.

(10) Patent No.: US 6,977,589 B2
(45) Date of Patent: Dec. 20, 2005

(54) DESICCANT BAG WITH ENCLOSED EAS TAG AND SECURITY MARKINGS

(75) Inventors: Calvin L. Loop, deceased, late of Manhattan Beach, CA (US); by Robert C. Loop, legal representative, Thousand Oaks, CA (US); Bradley A. Wolk, Studio City, CA (US)

(73) Assignee: Desiccare, Inc., Pomona, CA (US)

( * ) Notice: Subject to any disclaimer, the term of this patent is extended or adjusted under 35 U.S.C. 154(b) by 0 days.

(21) Appl. No.: 10/016,653

(22) Filed: Dec. 5, 2001

(65) Prior Publication Data

US 2003/0151512 A1 Aug. 14, 2003

Related U.S. Application Data

(60) Provisional application No. 60/251,688, filed on Dec. 5, 2000.

(51) Int. Cl.[7] ..... G08B 13/14

(52) U.S. Cl. ..... 340/572.8; 340/568.1; 340/572.5; 340/500

(58) Field of Search ..... 340/572.8, 500, 340/540, 568.1, 572.1, 572.3, 551, 572.5

(56) References Cited

U.S. PATENT DOCUMENTS

| | | | | |
|---|---|---|---|---|
| 2,446,361 | A * | 8/1948 | Clibbon | 312/31.1 |
| 5,005,125 | A * | 4/1991 | Farrar et al. | 340/572.1 |
| 5,743,942 | A * | 4/1998 | Shelley et al. | 96/118 |
| 5,790,029 | A * | 8/1998 | Curnutte et al. | 340/572.1 |
| 5,935,304 | A * | 8/1999 | Shelley et al. | 96/118 |
| 6,254,953 | B1 * | 7/2001 | Elston | 340/572.8 |
| 6,352,152 | B1 * | 3/2002 | Anderson et al. | 206/204 |

* cited by examiner

*Primary Examiner*—Jeffery Hofsass
*Assistant Examiner*—Daniel Previl
(74) *Attorney, Agent, or Firm*—Christie, Parker & Hale, LLP

(57) ABSTRACT

A desiccant bag for adsorbing moisture from a surrounding space in a packaged product includes on its inner surface an electronic article surveillance or EAS tag which enables detection of stolen products by theft or shoplifter detectors. The EAS tag is not visible from the outside of the bag or product package, and is thus unlikely to be detected and removed by a thief. The bag may also be printed with an invisible message or taggant containing information such as source or intended destination.

6 Claims, 1 Drawing Sheet

2
2
10
11
12
13
14
15
16
17

DESICCANT BAG WITH ENCLOSED EAS TAG AND SECURITY MARKINGS

CROSS REFERENCE TO RELATED APPLICATION

This application claims the benefit of U.S. Provisional Application 60/251,688 filed Dec. 5, 2000.

GENERAL DESCRIPTION OF THE INVENTION

This invention relates to a desiccant bag for adsorbing water vapor from a surrounding space, and with an enclosed electronic article surveillance (EAS) tag for activating theft and shoplifting detectors. The bag is made of FDA-approved material, and is especially suitable for use in premium pharmaceutical products which are subject to shoplifting in retail stores. In such applications, the EAS tag is invisible and within a tamper-proof sealed pharmaceutical bottle or other package, thus eliminating risk of removal by a shoplifter.

Desiccant bags of various types and sizes are known, and commercially available from several commercial sources including Desiccare, Inc., in Santa Fe Springs, Calif., assignee of the present invention. Large sizes are useful in high-volume applications such as product containers transported on container ships. Small sizes are easily fitted within a container such as a sealed pharmaceutical-product bottle. Bags of these types are filled with a desiccant (typically silica gel, molecular sieve, montmorillonite clay, carbon, or mixtures of these materials) to adsorb moisture vapor and odors from within the container.

EAS tags (sometimes called "source tags") are also well known, and are available in various types such as acoustic-magnetic, radio frequency, microwave, and electromagnetic, described in numerous U.S. patents such as U.S. Pat. Nos. 4,063,229, 4,510,489–490, 4,660,025, 5,357,240, etc. These tags are normally deactivated (typically magnetically) at a checkout counter, but if not deactivated, a shoplifted product is detected at the store exit to alert security personnel.

Use of EAS tags on high-value products is known, but the tag is typically placed on the product, or on the inside or outside of a product carton (or on the outside of a product container such as a pharmaceutical bottle) where it can be detected and surreptitiously removed by an experienced shoplifter. Placement of an exposed tag directly within a pharmaceutical bottle, for example, in direct contact with the product is unacceptable in view of FDA and other regulations which sharply limit the materials permitted to contact such products. This invention enables the EAS tag to be effectively sheathed and hidden within an envelope of FDA-approved material which also contains a desiccant.

In an alternative embodiment, normally invisible messages called taggants can be printed on a desiccant bag, and made visible by, for example, illuminating with ultraviolet light. The messages can contain various commercial information such as source, intended destination (thus enabling detection of diverted shipments), product characteristics, and the like. Taggants of various types are well known, and are disclosed in, for example, U.S. Pat. Nos. 4,736,425, 5,139,812, 5,421,869, 5,516,362, 6,174,400, 6,217,175, and 6,316,082.

SUMMARY OF THE INVENTION

The desiccant bag of this invention comprises a sealed bag of a material pervious to vapor, but impervious to liquid and particulates, a desiccant material in the bag, preferably silica gel, for adsorbing vapor, and an EAS tag secured to an inner surface of the bag. In one embodiment, the bag further includes an encoded or invisible taggant printed on an outer surface of the bag.

DESCRIPTION OF THE PREFERRED EMBODIMENTS

Figures 1, 2, 3, 4, 5:
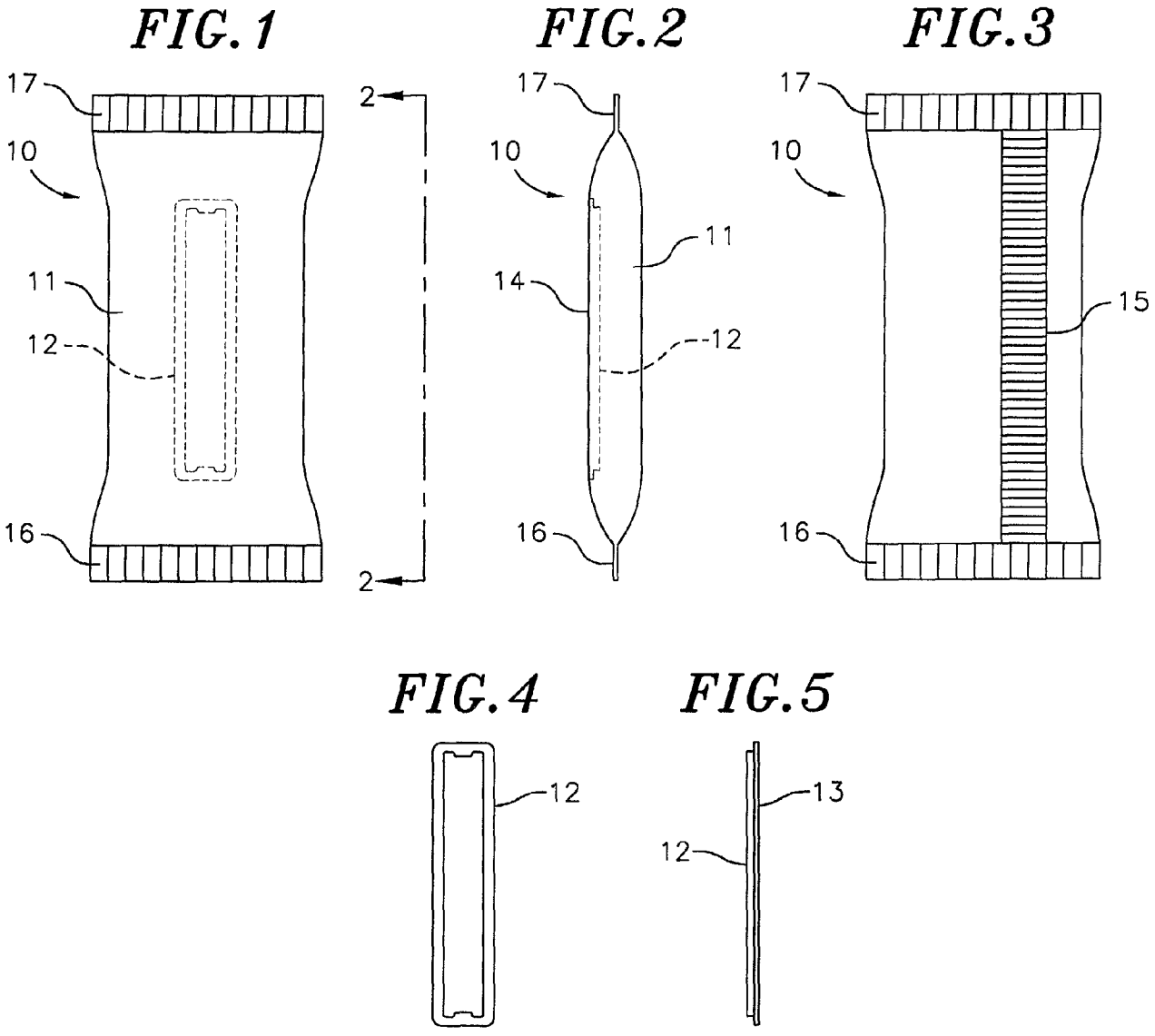
FIG. 1 is a front elevation of a desiccant bag according to the invention.
FIG. 2 is a side view on line 2—2 of FIG. 1.
FIG. 3 is a rear elevation of the bag.
FIG. 4 is a front elevation of an EAS tag.
FIG. 5 is a side view of the tag shown in FIG. 3.

FIGS. 1–3 show an assembly 10 of a desiccant bag 11 with an enclosed EAS tag 12, the tag being shown in greater detail in FIGS. 4–5. The bag is made of a porous material which will pass water vapor, but is impervious to liquid water, dust, and other particulates. A presently preferred sheet material for the bag is a spun-bonded polyolefin marketed by E.I. duPont under the trademark TYVEK®. This material in a thickness of about 0.4 to 0.7 mils is satisfactory for bags packaged with pharmaceutical products, and has good moisture-vapor transmission, while bidirectionally blocking liquid and particulates.

The bag is filled with a desiccant which is preferably particulate silica gel which is highly capillary, and thereby has a large adsorptive surface area. EAS tag 12 has a rear side 13 which is self-adhesively secured to an inner surface of a front face 14 of the bag. A suitable and presently preferred acoustic-magnetic EAS tag is marketed by Sensormatic Electronics Corporation, Boca Raton, Fla., under the trademark ULTRA-STRIP III.

The bag is designed to be made by automatic manufacturing machines of a known type called "form, fill and seal" machines. The first step is to draw and cut a flat sheet of the polyolefin material from a roll of the material. The EAS tag is then pressed against and adhesively bonded to the side of the sheet which will form the inner surface of the bag. The sheet is then machine folded about its length to form a tube which is longitudinally heat sealed as shown at 15 in FIG. 3. One end of the bag is then heat sealed to form a first closed end 16, and the bag is then machine filled with the particulate desiccant. Silica-gel desiccant loads of about 0.5 to 2.0 grams are typical. The filled bag is then closed by another heat seal which forms second closed end 17.

In a typical size suitable for use in a pharmaceutical container, the assembled bag is about 2 7/16" long, 7/8" wide, and 3/8" thick. Larger and smaller sizes are also practical, depending on the size of the container in which the bag is inserted, and the amount of desiccant needed to insure adequate adsorption of water vapor.

The EAS tag is magnetically deactivated when the protected product is paid for at a checkout counter. A pilfered product, on the other hand, will be sensed by commercially available detectors at the store exits, and an alarm sounded to alert security personnel to the theft.

While described primarily in terms of use in pharmaceutical packaging, the invention is equally useful in a variety of other applications where moisture control and anti-theft protection are important. For example, in the packaging of cameras and electronic products, or of hygroscopic materials. In these typical uses, FDA-approved materials are usually not required, and other desiccants and bag materials (such as paper and nonwoven sheets) are satisfactory, and provide desired EAS-tag security coupled with prevention of rust and corrosion.

Another feature of the invention is placement of an invisible or encoded message or taggant on the outside of the desiccant bag as discussed above. The taggants can be printed at spaced intervals on the desiccant-bag material while it is in roll form. Reading of the taggant is typically done with ultraviolet illumination, but other types of illumination or decoding can be used. Placement of a taggant is also useful with desiccant bags of larger sizes, and which may not include an EAS tag.

What is claimed is:

1. A sealed desiccant bag made of a material which is pervious to vapor, and containing a desiccant for absorbing the vapor, and an EAS tag secured to an inner surface of the bag for detecting stolen articles in which the bag is packaged.

2. The bag of claim 1 in which the bag is spun-bonded polyolefin plastic.

3. The bag of claim 1 in which the desiccant is a silica gel.

4. The bag of claim 1 in which the EAS tag is of an acoustic-magnetic type.

5. The bag of claim 1, and further comprising a taggant printed on an outer surface of the bag.

6. The bag of claim 1 in which the bag is spun-bonded polyolefin plastic, the EAS tag is of an acoustic-magnetic type, and further comprising a taggant printed on an outer surface of the bag.

* * * * *